United States Patent [19]

Kushner et al.

[11] 4,015,914

[45] Apr. 5, 1977

[54] METERING PUMP WHEREIN TUBULAR PUMP IS RESPONSIVE TO FORCE IMPULSES

[75] Inventors: Jack Kushner, Lindenhurst; Henry G. Zwirblis, Nesconset, both of N.Y.

[73] Assignee: Delta Scientific Corporation, Lindenhurst, N.Y.

[22] Filed: May 18, 1972

[21] Appl. No.: 254,718

[52] U.S. Cl. ..... 417/478; 417/479

[51] Int. Cl.[2] ..... F04B 43/08; F04B 45/06

[58] Field of Search ..... 417/474, 475, 478, 479; 74/54

[56] References Cited

UNITED STATES PATENTS

| | | | |
|---|---|---|---|
| 143,480 | 10/1873 | Webb | 74/54 |
| 2,816,514 | 12/1957 | Freese | 417/474 X |
| 3,171,360 | 3/1965 | Walton | 417/474 |
| 3,679,331 | 7/1972 | Kushner | 417/478 X |

FOREIGN PATENTS OR APPLICATIONS

| | | | |
|---|---|---|---|
| 1,001,208 | 8/1965 | United Kingdom | 417/478 |

*Primary Examiner*—Carlton R. Croyle
*Assistant Examiner*—Thomas I. Ross
*Attorney, Agent, or Firm*—Pennie & Edmonds

[57] ABSTRACT

A metering pump is disclosed wherein discrete, precisely measured quantities of fluid are caused, at predetermined intervals, to flow through a tubular conduit in the pump in response to the impingement of force or energy impulses against the wall of the conduit.

4 Claims, 3 Drawing Figures

METERING PUMP WHEREIN TUBULAR PUMP IS RESPONSIVE TO FORCE IMPULSES

BACKGROUND OF THE INVENTION

In various types of chemical analysis there often arises a need for an accurate metering type pump which is capable of delivering a discrete quantity of one or more fluid samples to a container where the samples are mixed and analyzed. A water pollution-control system is an example of where such a pump is needed. In such a system a sample of the water being tested is mixed with predetermined quantities of various chemical constituents. Often it is necessary to automatically monitor the pollution level of the water in the system, and for this type of application a pump is needed which is capable of withdrawing a precisely measured quantity of water sample and mixing it with equally precise quantities of other chemical constituents needed for the analysis.

Pulsation type metering pumps have been used in applications of the type described where precision is important. In construction, these pumps usually include a pump body equipped with an inlet-outlet means and a flexible resilient walled tubular conduit connected between the inlet-outlet means. With such constructions, discrete precisely measured quantities of fluid are moved through the pump by squeezing the conduit section located between the inlet and outlet means. Valve means are usually provided in the pump to control the direction of fluid flow.

Generally, the squeezing action causes flexure of the conduit in a direction transverse to the length of the conduit. This flexure, in turn, causes compression of the conduit and thus a reduction in the internal volume thereof. In response to this volume reduction, a discrete quantity of fluid encased within the conduit is moved through the pump. The amount of fluid flow is, of course, equal to the amount of volume reduction which occurs as a result of the transverse flexure of the conduit wall. And, fluid flow with such pumps substantially ceases upon removal of the squeezing pressure.

One construction of the type referred to above is described in my co-pending U.S. Pat. application Ser. No. 31,686, filed Apr. 24, 1970 for Metering Pump and Valve, now U.S. Pat. No. 3679331.

Although prior art pulsation-type pumps provide several advantages, especially where precision is required, there are also certain drawbacks associated with these pumps. First of all, there is a tendency for solid particles and other impurities contained within the sample fluid to become entrapped within the conduit section between the inlet and outlet means of the pump. When this occurs the pump cannot operate with the required degree of precision. And, if enough particulate material becomes entrapped the conduit may become completely clogged causing stagnation of the fluid encased within the conduit. This condition is undesirable generally but it is especially undesirable when the pump is used in an application requiring continuous monitoring, as for example, in a pollution-control system.

In addition to particulate matter, air bubbles sometimes collect and become entrapped within the conduit. This phenomenon has the same undesirable effect on pump operation as instances of severe clogging attributable to entrainment of particulate material.

SUMMARY OF THE INVENTION

According to the present invention, a metering pump is provided which is capable of moving discrete quantities of fluid in precisely measured amounts; and, moreover, one in which the danger of clogging is substantially eliminated. In construction, the pump includes a pump body having at least one inlet and outlet means. A tubular conduit is connected between each inlet and outlet means. Transmitting means is provided for periodically imparting individual energy or force impulses each of relatively short duration against the wall of the conduit. In response to the impingement of these energy impulses against the conduit wall discrete quantities of fluid in the form of high momentum fluid waves are caused to flow through the conduit in substantially synchronized relationship to the impingement of the energy impulses against the conduit. The amount of fluid moved by each fluid wave is determined by the magnitude of the energy impulses.

In the preferred construction, the conduit has a resilient walled construction and the energy impulses are delivered to the conduit wall by the tapping action movement of a striker plate structure. The striker plate structure includes a hammer head element mounted for cyclical movement against the conduit wall and a drive mechanism for activating the hammer head. With this construction, each blow of the hammer head causes a sudden surge of fluid through the conduit. It will also be recognized that each blow of the hammer head against the resilient wall of the conduit causes flexure of the conduit and thus a reduction of its internal volume. However the quantity of fluid caused to flow in response to each blow of the hammer head is greater than the quantity of fluid flow attributable to the reduction of volume alone. The increased fluid flow is thought to be attributable to the momentum imparted to the fluid in response to the impingement of the short duration energy impulses against the conduit wall.

In addition to creating increased fluid flow, the tapping action of the striker plate structure creates a more positive fluid flow which helps to dislodge any entrapped particles or air bubbles continuously during pump operation thus substantially eliminating the necessity of shutting off the pump for the purpose of freeing entrapped particles or bubbles. Also, the tapping action itself tends to free particles trapped in the vicinity of the point of contact between the hammer head and the conduit.

DETAILED DESCRIPTION OF THE INVENTION

Figure 1:
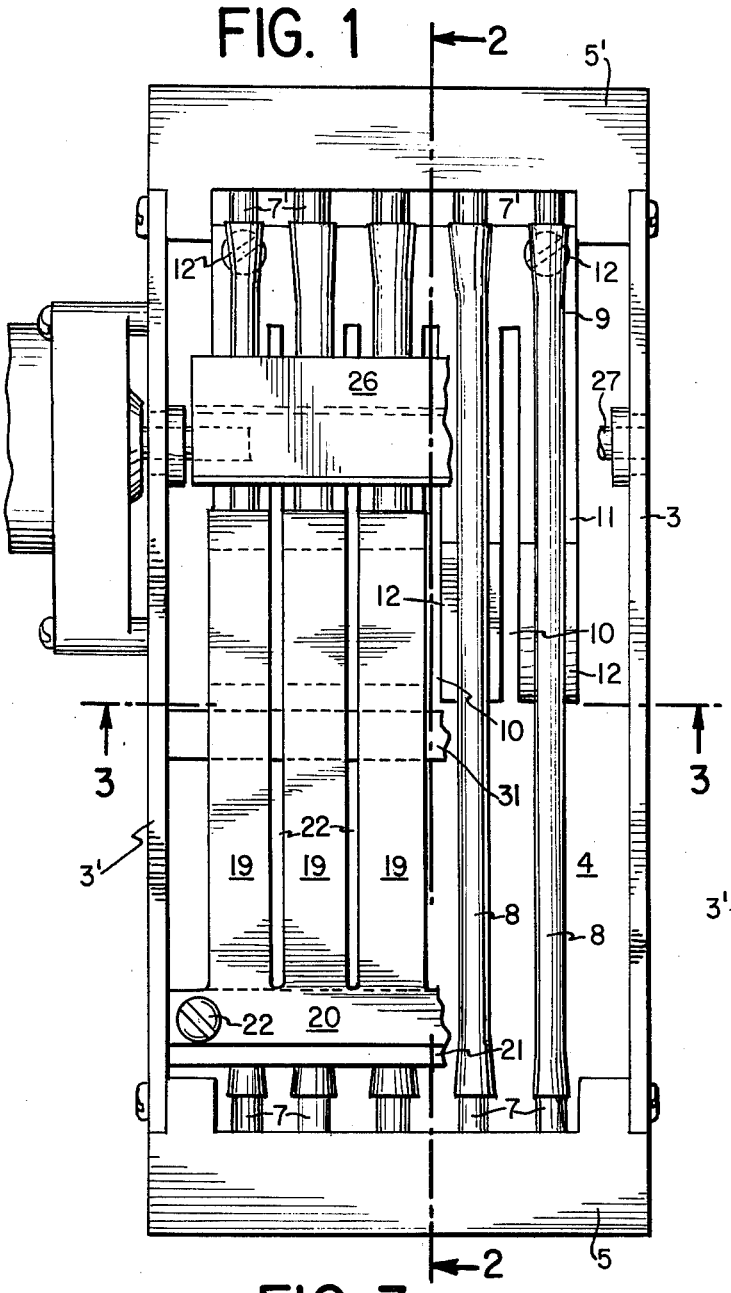
FIG. 1 is a back elevation view of the metering pump according to the present invention.

With reference to the drawings, the metering pump of the invention includes a pump body which consists of a U-shaped casing having side plates 3, 3', face plate 4, and end blocks 5, 5'. The inlet end of the pump body is defined by end block 5 and the outlet end of the pump is defined by end block 5'. Mounted within each end block 5, 5' are a plurality of elbows 6, 6', each of which communicates between the exterior and interior of the pump body.

Connected between the internal end 7 of each inlet elbow 6 and the internal end 7′ of each outlet elbow 6′ is a conduit 8. In the construction shown, the conduit 8 is made of suitable resilient plastic material.

A plate member 9 is mounted on the internal side of face plate 4 beneath the conduits 8. The plate member 9 has a series of longitudinal slots 10 disposed in parallel relationship to each other. As shown, the unslotted end of the plate member 9 is secured to face plate 4 by screws 12 while the slotted end of a plate member 9 is not secured to the face.

The slots 10 define movable fingers 11 each of which supports a block 12 positioned at an intermediate point along the adjacent overlying conduit 8. To effect movement of the fingers 11 each is provided with a volume control screw 14 which extends through the face plate 4 of the pump body into contact with the underside of the respective finger. Each screw 14 is provided with a threaded nut 15 which is locked in place on the external side of face plate 4. Adjustment of the volume control screws operates to adjust the position of the overlying conduit, the purpose of which will be described more fully hereinafter.

A flow control valve is connected to the internal end of each inlet and outlet elbow within the associated conduit. Each valve has a seat 16 which cooperates with a disc 17 in a well-known manner to control the direction of fluid flow through the conduit.

Figure 2:
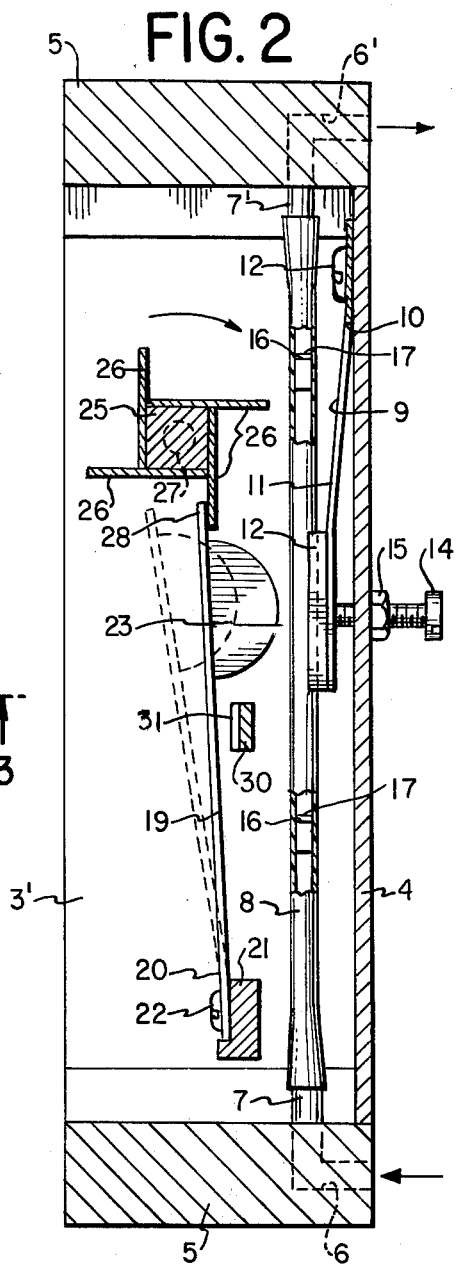
FIG. 2 is a cross section of the pump taken along the lines 2—2 of FIG. 1.
Figure 3:
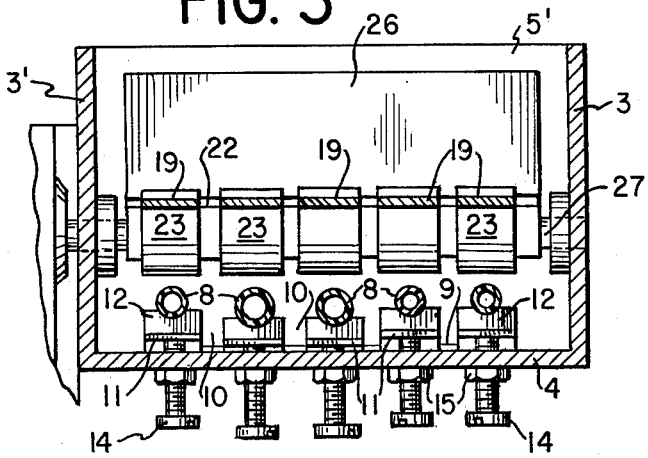
FIG. 3 is a cross section of the pump taken along the lines 3—3 of FIG. 1.

With reference now to FIG. 2, the metering pump of this invention is provided with transmitting means for imparting energy impulses of relatively short duration to the conduit section located between the inlet and outlet valves. In the construction shown, this means includes a striker plate structure. When actuated the striker plate structure operates to strike or tap the wall of the conduit at periodical intervals. The striker plate structure includes a hammer head assembly and a drive means for actuating the hammer head assembly.

The hammer head assembly consists of spring plate 20 which is secured at one end to support bar 21 by screws 22. The support bar which is positioned above the conduits 8 extends between side plates 3, 3′ of the pump body. The other or free end of spring plate 20 has a series of longitudinal slots 22 extending parallel to each other to thereby define a series of arms 19 each of which has a head 23 which faces the underlying conduit. The spring plate 20 is made of spring material having a sufficient spring coefficient to hold each head 23 spaced above the underlying conduit. With this construction each arm 19 functions basically as a leaf spring.

The drive means of the striker plate structure consists of rotor 25 and lifters 26 spaced around the periphery of rotor 25. In the construction shown, the rotor 25 has a square cross-sectional configuration and the lifters 26 are secured to the sides of the square rotor. With this arrangement the lifters extend at right angles with respect to each other. The rotor is journalled on shaft 27 for clockwise rotation as viewed in FIG. 2. As rotor 25 rotates in the clockwise direction the tips of lifters 26 successfully engage the tips 28 of arms 19.

In FIG. 2 a lifter 26 is just making contact with the tip 28 of one arm 19. Upon such engagement, the hammer head 23 is lifted to the position indicated by dotted lines in FIG. 2. Upon further rotation of rotor 25 the lifter 26 disengages the arm tip 28 thus allowing the arm 19 to move downward under spring tension bringing the hammer head 23 into relatively sharp contact with the conduit wall. Upon contact with the conduit wall, the spring tension returns the arm 19 and attached head 23 to its initial position where it is in position to be again lifted by the next lifter 26. It will be recognized that the speed of rotation of rotor 25 controls the frequency at which each hammer head is brought into contact with the conduit.

As mentioned above, the conduit of the preferred embodiment is made of flexible resilient material. It will be therefore recognized that the conduit is flexed upon impact of the hammer head and a reduction in internal volume of the conduit takes place. As also mentioned above, the hammer head delivers an energy impulse of relatively short duration. The energy impulses are of relatively short duration in the sense that the hammer head is brought to bear against the conduit and retracted therefrom before the resilient conduit can recover its original non-flexed condition. In other words, the force of the hammer head is removed before the conduit resumes in initial non-flexed position. And, fluid flow continues for a brief period after the force delivered by the hammer head is removed.

The reduction in volume caused by flexure of the conduit is, in itself, sufficient to cause a discrete quantity of fluid encased within the conduit section to flow through the pump. However, with the tapping action movement of the hammer assembly against the conduit according to the present invention, the quantity of fluid flow which is moved each time the hammer strikes the conduit is significantly greater than the quantity of fluid flow attributable to the reduction in volume alone. The quantity of fluid flow each time the hammer head strikes the conduit is, rather, dependent primarily on the magnitude and duration of the energy impulse or the hammer head blow. With a conduit made of silicone plastic having an O.D. of approximately ⅜inches and an I.D. of approximately ¼inch, it has been found that the ratio of fluid flow utilizing the energy impulse impingement concept as disclosed herein to fluid flow created by volume reduction alone is approximately 10:1.

The metering pump of the present invention provides several advantages. First of all, the tapping action of the hammer head creates a scouring and cleaning action on the inlet and outlet valves and associated tubing which advantageously lessens the chance of undesirable build-up of solid material or air bubbles. Thus the pump is self-cleaning which reduces the down time heretofore necessary for cleaning the pump. Secondly, the pump disclosed herein produces a sudden pressure wave of fluid through the conduit. In addition to augmenting the self-cleaning feature of the pump, this sudden pressure wave produces enhanced positive valve action.

Each individual conduit of the pump may be adjusted to produce a different quantity of fluid flow. This may be accomplished simply by adjusting the volume control screws 14 thus repositioning the overlying conduit in relation to the hammer head. And, if a finger adjustment of the relative fluid flow through the various conduits is desired, a separate striker plate structure may be provided for each conduit. With this modification of the construction shown in the drawings, a three-way adjustment of fluid flow may be provided for each conduit independently of the other conduits. In other words, with such an arrangement fluid flow for each conduit can be controlled by (1) adjustment of volume control screws 14 and/or (2) adjustment of the frequency at which the hammer head strikes the conduit by, for example, increasing the speed of rotation of the rotor 25 and/or (3) adjusting the magnitude of the energy impulses by, for example, changing the spring tension in arm 19. As shown in FIG. 2, an arrestor bar 30 fitted with a rubber pad 31 is positioned beneath the spring arms 19. The arrestor bar acts to stop downward movement of the spring arms 19 at a predetermined position which can be adjusted to facilitate other flow control adjustments. In addition, the arrestor bar substantially eliminates oscillation of the spring arms at low delivery volumes so that the pump can run at higher speeds. Furthermore the rubber pad on the arrestor bar helps to silence operation of the pump.

It will be recognized from the above description of the invention that modifications, other than those specifically mentioned, may be made without departing from the spirit and scope of the appended claims.

We claim:

1. A metering pump comprising:

a. a pump body having at least one inlet and outlet means;

b. a tubular conduit connected between each inlet and outlet means, the wall of said conduit being of resilient material which is flexible in a direction transverse to the length of the conduit; and c. transmitting means for periodically imparting against the conduit force impulses having a magnitude and duration sufficient to move discrete quantities of fluid through said conduit in substantially synchronized relationship to the impingement of said force impulses on said conduit and to impart momentum to the fluid sufficient to sustain movement thereof through said conduit after the force has been removed, said transmitting means including:

1. a striker plate structure including a hammer-like member having a spring biased arm and a head element mounted on the arm, said structure being mounted on said pump body adjacent to and on one side of the conduit for cyclical tapping action movement between a first position spaced from the conduit and a second position in contact therewith to deliver said force impulses thereto, each force impulse causing flexure of the conduit and each force impulse having a relatively short duration with respect to the recovery time of resilient conduit wall, and 2. drive means for actuating said hammer-like member, said drive means including:

i. a driven rotor, and ii. at least one lifter element mounted on the rotor for engagement with said arm upon rotation of the rotor to thereby cause movement of said hammer-like member between said first and second positions.

2. The metering pump according to claim 1 wherein:

a. said arm consists of a leaf spring.

3. The metering pump according to claim 1 including a. volume control means for the conduit extending lengthwise along the side thereof opposite said striker plate structure; said volume control means being mounted for movement relative to said conduit; and b. means for adjusting and fixing the position of the volume control means relative to said conduit.

4. A metering pump according to claim 3 wherein said second position is adjustable.

* * * * *